US009034110B2

(12) United States Patent
Johns et al.

(10) Patent No.: US 9,034,110 B2
(45) Date of Patent: May 19, 2015

(54) METHOD OF CLEANING TUBES

(75) Inventors: Clifford L. Johns, Louisville, KY (US); August M Dattilo, III, Louisville, KY (US); Munaf Najmuddin Chasmawala, Louisville, KY (US); Manfred Schmidt, Louisville, KY (US)

(73) Assignee: Extundo Incorporated, Louisville, KY (US)

( * ) Notice: Subject to any disclaimer, the term of this patent is extended or adjusted under 35 U.S.C. 154(b) by 1848 days.

(21) Appl. No.: 12/133,746

(22) Filed: Jun. 5, 2008

(65) Prior Publication Data

US 2008/0302388 A1 Dec. 11, 2008

Related U.S. Application Data

(60) Provisional application No. 60/942,737, filed on Jun. 8, 2007, provisional application No. 60/942,735, filed on Jun. 8, 2007.

(51) Int. Cl.
*B08B 9/055* (2006.01)
*F28G 1/12* (2006.01)

(52) U.S. Cl.
CPC ..... *F28G 1/12* (2013.01)

(58) Field of Classification Search
USPC ..... 134/22.1, 22.11, 22.12, 22.13, 22.14, 134/22.15, 22.16, 22.17, 22.18, 2, 2.19, 7, 134/8, 9, 6, 37, 42
See application file for complete search history.

(56) References Cited

U.S. PATENT DOCUMENTS

| | | | | |
|---|---|---|---|---|
| 3,631,555 | A * | 1/1972 | Hurst et al. | 15/3.5 |
| 5,222,533 | A | 6/1993 | Porter, Jr. | |
| 5,423,917 | A | 6/1995 | Garcia | |
| 5,621,998 | A * | 4/1997 | Norgaard | 42/89 |
| 6,725,706 | B2 | 4/2004 | Johns | |
| 2004/0173008 | A1 * | 9/2004 | Johns et al. | 73/49.5 |

FOREIGN PATENT DOCUMENTS

| | | | |
|---|---|---|---|
| GB | 2 173 122 | 10/1986 | |
| WO | WO 00/47938 | 8/2000 | |
| WO | WO 2005/007308 | 1/2005 | |
| WO | WO 2005007308 A1 * | 1/2005 | B08B 9/04 |

OTHER PUBLICATIONS

Conco Systems Inc. <http://www.concosystems.com/tubecleaningsystem.php> Oct. 26, 2005.*

* cited by examiner

*Primary Examiner* — Michael Kornakov
*Assistant Examiner* — Katelyn Whatley
(74) *Attorney, Agent, or Firm* — Camoriano and Associates

(57) ABSTRACT

A method for grit blasting tubes and for blowing swabs through tubes, automatically sensing that the swab has passed through the tube, and logging the event. Also, various methods are used for inserting the swabs into the tubes efficiently.

16 Claims, 13 Drawing Sheets

METHOD OF CLEANING TUBES

This application claims priority from U.S. Provisional Application Ser. No. 60/942,737 filed Jun. 8, 2007 and from U.S. Provisional Application Ser. No. 60/942,735 filed Jun. 8, 2007.

The present invention relates to a device and a method for cleaning tubes and is particularly useful for cleaning tubes that are mounted on a tube sheet in a heat exchanger vessel, such as a chemical reactor.

BACKGROUND

Many chemical reactors are made as shell-and-tube heat exchangers, with many parallel, vertical tubes extending from a top tube sheet to a bottom tube sheet. During use, the tubes typically contain catalyst. Periodically, the reactor is shut down, the catalyst is removed, the tubes are cleaned out, and generally new catalyst is loaded.

In order to clean out the tubes of these heat exchangers, grit blasting often is used. Grit blasting uses an abrasive material, which may be sand, other mineral-type abrasives, dry ice pellets, or other similar abrasive material, to clean the tubes. In that procedure, a grit blasting nozzle is generally inserted into the tube by hand. It is important for the operator to keep the grit blasting nozzle axially aligned with the reactor tube so it directs the abrasive material down the tube. If the nozzle gets cocked off of the longitudinal axis of the tube, directing the blast of abrasive material against the wall of the tube, or if the grit blasting time period is too long, it is possible to blast a hole through the wall of the tube, which is not desirable.

The gas used for grit blasting of sand or other mineral-type abrasives is commonly 100% oil-free dessicant dried air with a dew point of approximately minus 40 degrees Fahrenheit, while the gas to propel the frozen carbon dioxide abrasive material (dry ice pellets) may have a dew point that is even lower.

Grit blasting may be hazardous to personnel performing the cleaning, and serious injury including death can result if the flow of the abrasive material is not properly controlled. For example, if the grit blasting nozzle gets loose outside of the tube while forcefully blowing abrasive material, it can do other damage to the reactor and attached and surrounding peripherals or to the people working in the reactor.

Grit blasting is often followed by the insertion of a swab. Swabs, sometimes referred to in the trade as "pigs", can be made of foam, felt, cloth, or similar materials; there may be abrasive materials deposited or embedded in the material, and there may be various combinations of materials, with or without abrasives added. The swabs are inserted into the tubes and are pushed through mechanically, or are blown through with gas pressure. A swab wipes the sidewall of the tube as it passes through the tube, thereby cleaning off the wall of the tube. It takes time to load all the swabs and pass them through their respective tubes. Since there may be thousands of tubes in a reactor, it would be helpful to be able to speed up the process and to have a way of keeping track of which tubes have been swabbed. Also, a swab may be left in a tube accidentally, which adversely affects the functioning of the reactor.

DETAILED DESCRIPTION

Figure 1:
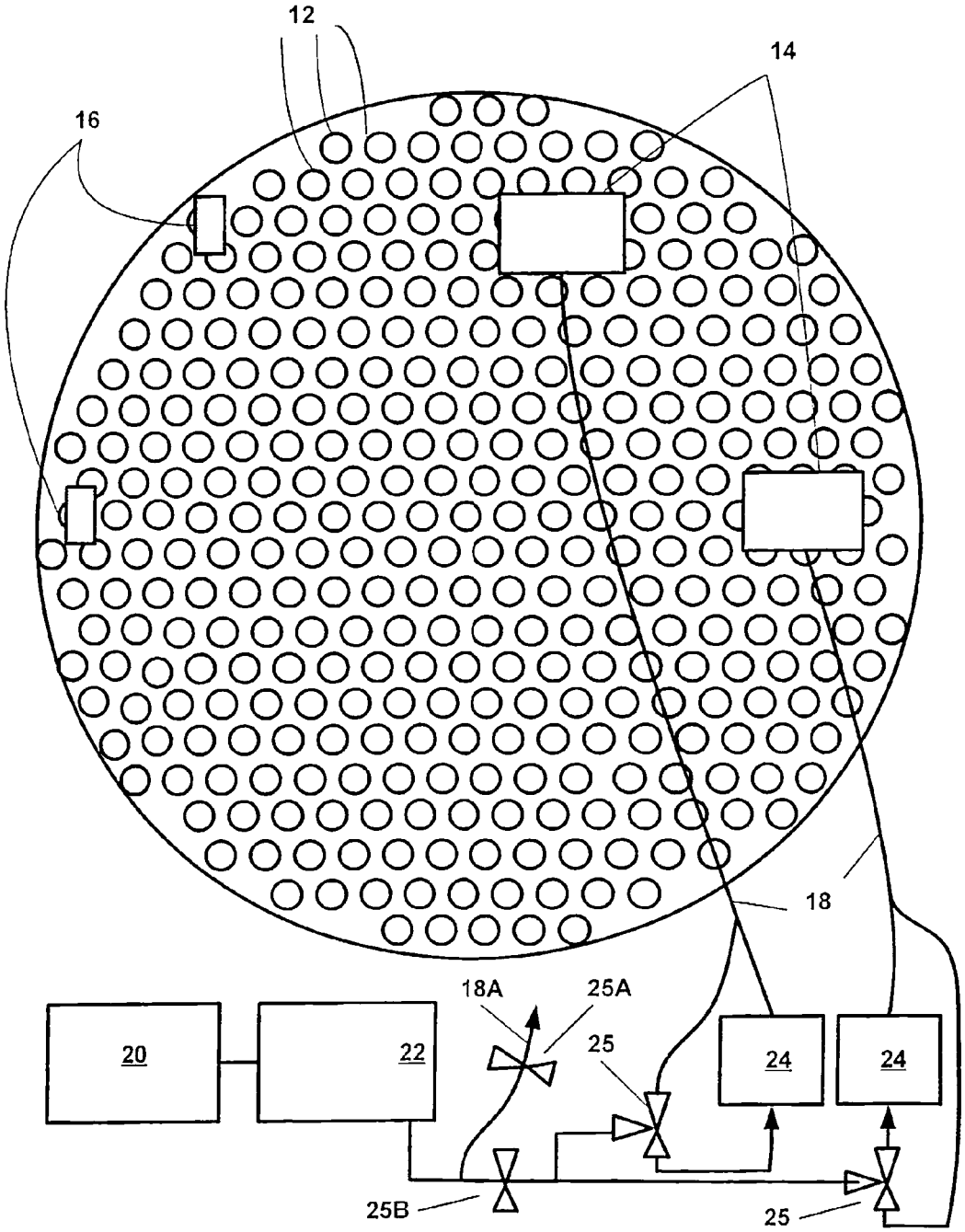
FIG. 1 is a schematic view of a tube sheet on which are mounted grit blast devices made in accordance with the present invention.

FIG. 1 is a schematic view showing the top tube sheet 10 of a chemical reactor, with a plurality of holes 12 in the tube sheet 10. Each of the holes 12 is the top end of a vertical tube 34 (See FIG. 1A), which, during normal operation of the reactor, typically houses a catalyst material, which is usually in the form of a friable, porous pellet. During a reactor shutdown, when the catalyst is being changed out, it may be desirable to clean out the reactor tubes 34. One of the methods for cleaning the tubes is grit blasting.

FIG. 1 shows two grit blast modules 14, each of which sends a stream of air and abrasive material into one or more of the reactor tubes 34 in order to clean the tubes 34. Each of the grit blast modules 14 is aligned with a target 16, which is used to measure the position of the reactor tubes being treated, as will be explained later. Each of the grit blast modules 14 also is connected to a hose 18, which transports the gas/abrasive material mixture to the module 14. A compressor 20 sends a pressurized stream of air through a dryer 22 and then to a pot 24, which holds a supply of abrasive material. The air stream picks up the abrasive material from the pot 24 and then transports it through the hose 18 to the grit blast module 14. There is a valve 25 upstream of the pot 24 which can be switched so that the air stream either passes through the pot 24 and picks up abrasive material or flows straight through to the hose 18 without picking up abrasive material. There also is a valve 25A at each grit blast module 14, which controls a separate stream of air, flowing through a line 18A, that is used to inflate a sleeve on the module 14, as will be described later. There also is a valve 25B upstream of the valves 25, which turns the air flow on and off.

Figure 1A:
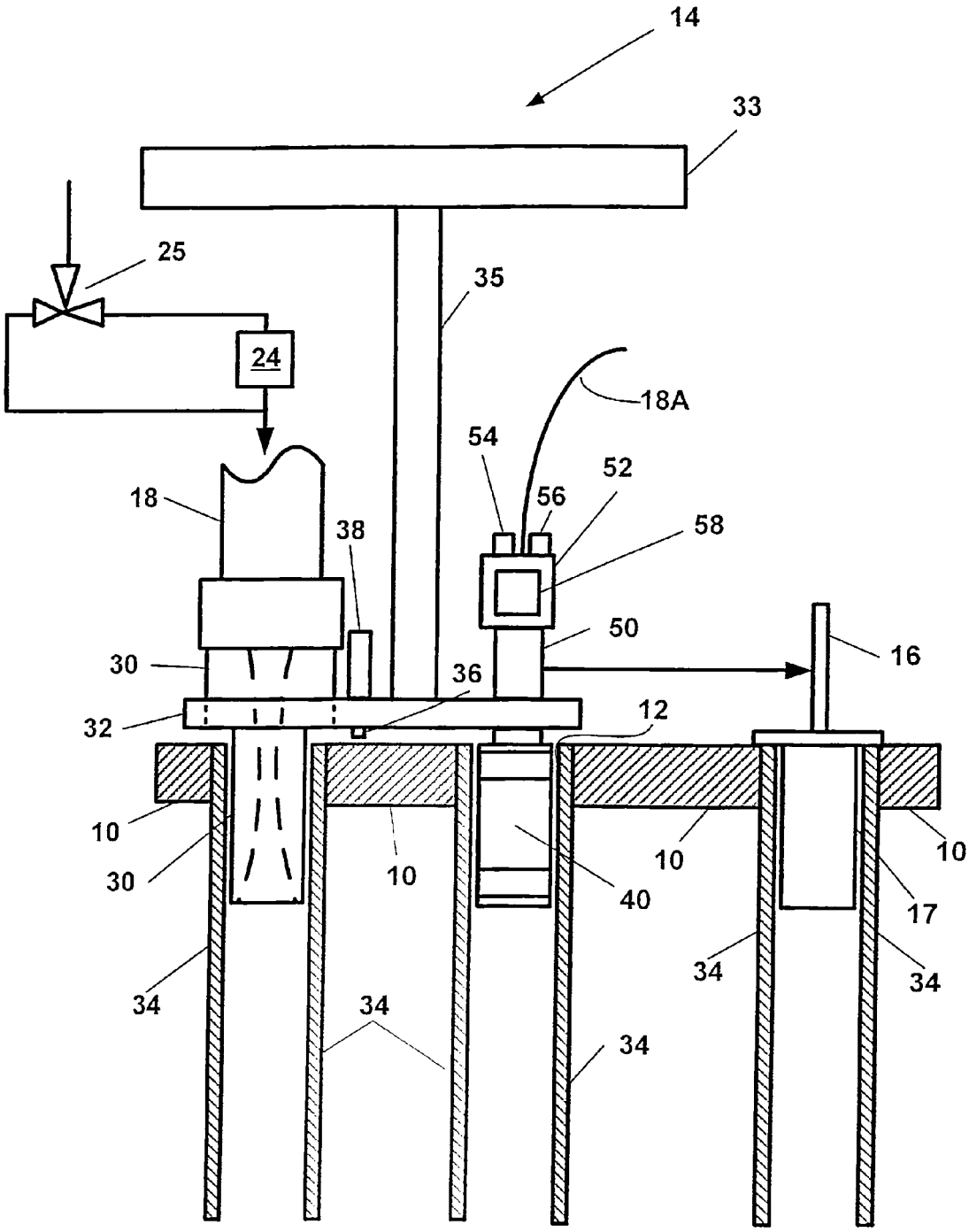
FIG. 1A is a broken-away section view through the tube sheet and through one of the modules and targets of FIG. 1.

The grit blast module 14 may have just a single nozzle 30 for grit blasting a single tube 34 of the reactor as shown in FIG. 1A, or it may have more than one nozzle, for grit blasting more than one tube at a time. If it has more than one nozzle 30, the nozzles all will be rigidly mounted to the same plate 32 and spaced apart a distance that corresponds to the distance between the holes 12 in the tube sheet 10 so that all the nozzles 30 on the module 14 are inserted into their respective tubes at the same time. If there are multiple nozzles 30 on the module 14, there also is a manifold or some type of splitter (not shown) in order to split the flow from the hose 18 to the individual nozzles 30 or there are separate hoses 18 to each nozzle 30. It should be noted that the use of a compressor 20, pot 24, hose 18, and nozzle 30 are well known in the art, and those components of this system would be essentially the same as in the prior art.

As shown in FIG. 1A, the nozzle 30 (or nozzles 30) is rigidly mounted on the flat plate 32 so that, when the plate 32 is resting flat against the tube sheet 10, the nozzle 30 is directed axially downwardly along the reactor tube 34 into which it has been inserted. There may be spacers (not shown) on the bottom of the plate 32 to position the plate 32 slightly above the generally flat surface of the tube sheet 10 in order to accommodate irregularities in the top surface of the tube sheet 10, such as reactor tubes 34 or slag deposits that extend slightly above the tube sheet 10, while still keeping the plate 32 parallel to the flat surface of the tube sheet 10. The handle 33 is also rigidly mounted to the plate 32 via the upright 35, with the length of the upright 35 being such that the handle 33 is approximately at the waist height of the operator when the plate 32 is resting on the tube sheet 10 and the operator is standing on the tube sheet 10. Also mounted on the plate 32 and projecting downwardly (in the same direction as the nozzle 30) is a spring-biased pin 36, which triggers a switch 38. When the plate 32 (with or without spacers) is resting on the tube sheet 10, with the nozzle 30 inserted into its respective tube 34, the pin 36 is depressed against the spring bias, triggering the switch 38, which communicates with a controller or computer 52 on the device 14 to let the controller 52 know that the module 14 is properly inserted. This serves as an interlock, as the controller 52 will only permit the valve 25 to be in a position to allow the abrasive material to flow through the nozzle 30 when the pin 36 is depressed and the switch 38 is triggered.

An inflatable tube seal assembly 40 is rigidly mounted on the plate 32, also projecting downwardly from the plate 32, in the same direction as the nozzle 30. This tube seal assembly 40 receives compressed air through a separate line 18A. There may be two or more spaced-apart tube seal assemblies 40, if desired. (The type of tube seal assembly used here is shown in detail in FIG. 9 of U.S. Pat. No. 6,725,706, which is hereby incorporated herein by reference, and includes an inflatable sleeve 56 and an inflation tube 62 for inflating the sleeve 56.) The tube seal assembly 40 is spaced apart from the nozzle 30 a distance that corresponds to the spacing between two of the reactor tubes 34, so that, when the nozzle 30 is in one of the tubes 34, the tube seal assembly 40 is in another of the tubes 34. FIG. 1A shows the nozzle 30 and tube seal assembly 40 in adjacent reactor tubes 34, which is preferred but not required.

Also rigidly mounted on the plate 32 are a laser measurement device 50, the controller 52, a switch 54, an indicator lamp 56, and a display 58. FIGS. 1 and 1A also show a target 16, which is mounted in another of the reactor tubes 34 by means of a pin 17. The method of using the laser measurement device 50 to measure the distance to the target 16 and to correlate that distance with the location of the device 14 on the reactor and with the specific reactor tube or tubes that are being treated is shown and described in U.S. Pat. No. 6,725,706 which is incorporated herein by reference. In the '706 patent, the device was tracking which tubes were being measured. In this case, it is tracking which tubes are being grit blasted.

The controller 52 controls the operation of the valves 25, 25A, 25B in order to control the flow of air and abrasive material through the grit-blasting device 14. This grit-blasting device is used as follows:

The operator picks up the handle 33 of the grit blast module 14 and carries the module 14 to a desired location on the reactor. He then aligns the module 14 with some of the reactor tubes 34, so that, as he lowers the module 14, the nozzle 30 (or nozzles 30) goes into its respective reactor tube 34 (or tubes 34) and the tube seal assembly 40 (or assemblies 40) goes into its respective reactor tube 34 (or tubes 34). He then activates the switch 54 to begin the grit blast procedure.

If the pin 36 has been depressed, triggering the switch 38 to indicate to the computer 52 that the plate 32 is flat on the tube sheet 10, then the computer 52 will begin an automated sequence. First it activates the valve 25A in the air line 18A to inflate the tube seal assembly 40 (or assemblies 40). This anchors the grit blast module onto the reactor so it will not come loose and present a hazard when the high velocity and high volume of abrasive material/air begins passing through the nozzle 30 (or nozzles 30). Without this holding mechanism, the operator would have to manually secure the nozzle into the tube sheet and use gravity along with leaning on the nozzle to hold it in place against the reactionary force of the air and abrasive material. The inflated tube seal assembly 40 not only anchors the grit blast module 14 onto the tube sheet 10, but it, in conjunction with the flat plate 32, also ensures that the longitudinal axis of the nozzle 30 is substantially aligned with the longitudinal axis of the tube 34, so that the nozzle 30 directs its air flow and abrasive material axially along the tube 34.

Next, it uses the laser measurement device 50 to measure the distance to the target 16, from which it determines the position of the module 14 and automatically identifies the tube 34 (or tubes 34) that is being treated by the module 14 based on that measurement.

Next, the computer 52 causes the valves 25 and 25B to shift to positions that direct air to flow through the pot 24, initiating the flow of the air/abrasive material mixture through the nozzle 30. The valves 25 and 25B are probably located a substantial distance away from the controller 52, and, in this preferred embodiment, there is an electrical wire extending from the controller 52 to each of the solenoid valves 25, 25B to control the positions of those valves. (Instead of opening and closing the valve 25B, the controller 52 could turn the compressor 20 on and off, but it is generally considered preferable to open and close the valve 25B and keep the compressor 20 operating.)

Once the computer initiates the flow of the air/abrasive material mixture through the nozzle 30, it times the process, allowing the air/abrasive material mixture to flow through the nozzle 30 for a fixed period of time, so the tube 34 is grit blasted for a standardized time period, which is set in the software that controls the controller 52. This time period may be set for each reactor. The controller 52 also controls the indicator lamp 56, which includes colored lights that indicate to the operator when the air/abrasive material supply is flowing through the nozzle 30 (green) and when it is not flowing through the nozzle 30 (red). If at any time the switch 38 indicates to the controller 52 that the pin 36 is not depressed, the controller 52 will immediately stop the flow of the air/abrasive material mixture through the nozzle 30. This may be accomplished by turning off the compressor 20, switching off the valve 25B, or switching the valve 25 so the air bypasses the pot 24 holding the abrasive material. As mentioned above, it is generally considered to be preferable to switch one or both of the valves 25, 25B rather than to turn off the compressor.

The display 58 includes a count-down timer display and a count-up timer display, which facilitate unattended operation of the device 14. The controller 52 initiates these timers when it initiates the flow of abrasive material/air through the nozzle 30. The count-down timer tells the operator how long it will be before the grit blaster 14 has completed its cycle, which lets him know how much time he has to set up and start another grit blast module 14 in another tube 34 (or tubes 34). The count-up timer lets him know how long it has been since the module 14 has completed its cycle, so he knows how long the module 14 has been sitting idle. The data from these timers also is received by the controller 52 and can be electronically stored at the module 14 or electronically transmitted to a remote monitoring station, which helps supervise the operators, to see how efficiently they are working.

Once the tube(s) 34 has been grit blasted for the set time period, the controller 52 automatically shifts the valve 25 to stop the flow of the abrasive material and allow the flow of air for a preset period of time. Then the controller 52 automatically shifts the valve 25B to stop the flow of air through the nozzle(s) 30, turns on the red light at the display 56, turns on the count-up timer, and shifts the valve 25A to deflate the tube seal 40. The controller 52 also enters into the electronic record the fact that the identified tube(s) 34 has been grit blasted. Then the operator picks up the grit blast module 14, moves it to the next tube(s) 34, and initiates the switch 54 to start the process over again, with the controller 52 checking to be sure the switch 38 is activated to indicate that the device 14 is properly seated with the nozzle 30 in its tube 34 and the seal 40 in its tube, and the automatic sequence repeats.

As the controller 52 collects data from the laser measurement device 50 and determines from the measurements which tubes 34 are being grit blasted, it may transmit that data in real time, such as by a radio transmission, to a remote receiving station, as described in the '706 patent, so someone in a control room or some other location may monitor the work as it is being done. The monitor at the receiving end may have a screen showing a schematic representation of the tube sheet 10 and may have a color indicator or a cross-hatching or some other visual indicator that appears for each tube as it is being grit blasted to show in real time the progress of the operation—which tubes have been grit blasted, which are being grit blasted, and which have not yet been grit blasted. The person at the control room or other receiving location also may have other records concerning the reactor, which also may be shown visually, as described in the '706 patent, such as the test data from previous tests of the tube, which tubes are plugged, which have thermocouples, and so forth.

After the grit blasting has been done, swabs may be blown through the tubes 34 to further clean them out.

Figure 2:
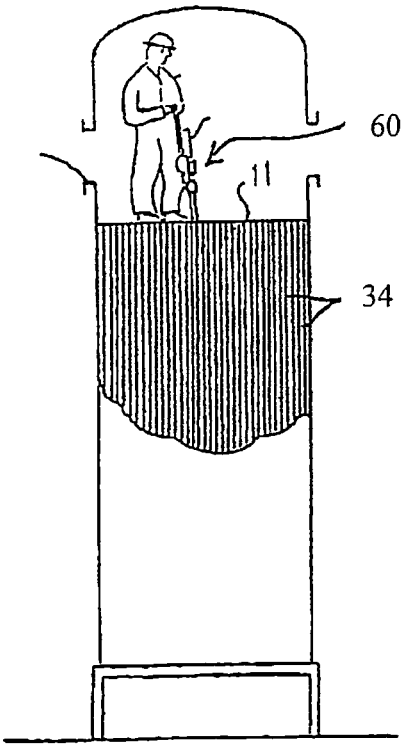
FIG. 2 is a schematic view of a person using a device to blow swabs through the tubes of FIG. 1.
Figure 2A:
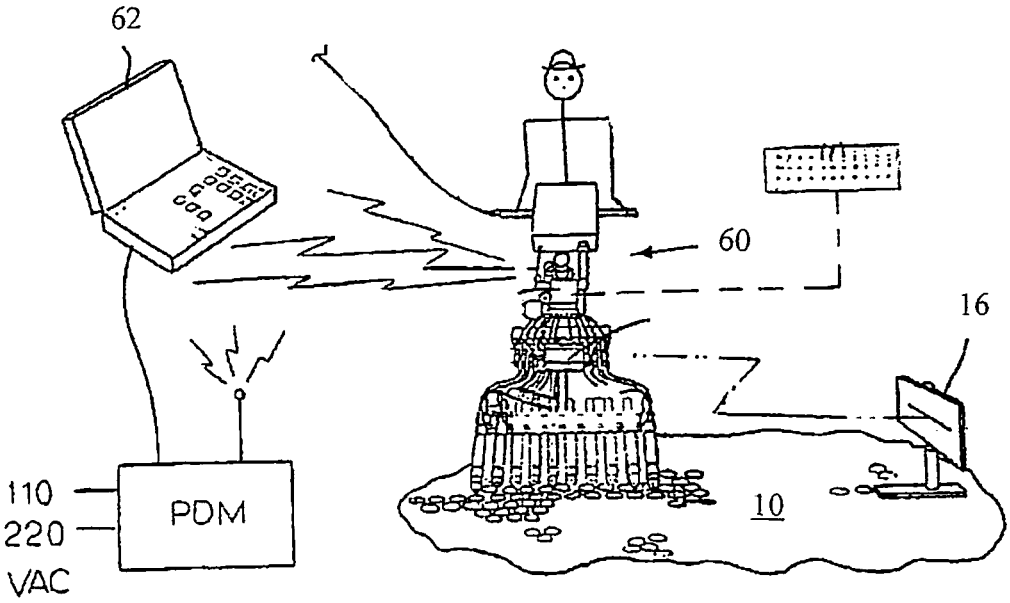
FIG. 2A is another schematic view of the person and device of FIG. 2.

FIGS. 2 and 2A are taken from the '706 patent, which describes a device 60 for testing reactor tubes 34. A similar device 60 may be used for blowing swabs through the tubes 34. As with the device 60 shown in the '706 patent, this device 60 has multiple air flow paths and injectors and an inflatable seal for each air flow path. In the '706 patent, there is a single pressure sensor, and there is a multiplexing valve that sequentially puts the pressure sensor in communication with each air flow path, one at a time. That arrangement may be used in this process as well. Alternatively, in this device 60, instead of using a single pressure sensor for the device and then multiplexing to cycle through each air flow path so the sensor can measure the back pressure in each air flow path, a separate, less precise and less expensive pressure sensor may be used for each air flow path of the device 60 so each pressure sensor is in continuous communication with its respective air flow path, and measurements can be taken for multiple paths at the same time, without having to wait for a multiplexer to cycle through each path.

Once the swabs are loaded into the tops of their respective reactor tubes 34 through some method, which may be just by manually inserting the swabs into the tubes or by some method as described below, the device 60 is used in the same manner described in the 706 patent, with the seals inflating to seal between the injectors and the tubes and then air being blown through the injectors, except now the air flowing through the air flow paths of the injectors is used to blow the swabs through their respective tubes. The laser measurement and tracking feature described in the '706 patent is used to identify and keep track of which tubes are being treated (swabbed by swabs). The pressure sensor(s) senses when the back pressure for each flow path has exceeded a certain set pressure, indicating that there is a swab in the tube, and that event is automatically recorded electronically in the data logging on the device 60 to have an electronic record of which tubes have been treated. That data also is transmitted to the remote computer 62 in real time. Then, when the swab has been pushed all the way through the tube, the pressure sensor(s) senses that the back pressure drops precipitously to a substantially lower pressure, below a certain set point, and that event also is measured, logged, and transmitted for each respective tube. This produces a record at the device 60 and at the remote station 62 to show which tubes have been "swabbed" and to show that the swabs have passed all the way through and fully out of their respective tubes and that no portion of a swab is still remaining in any tube.

Depending upon the number of air injectors on the device 60 and the force that is generated by the air pressure, it may not be necessary to use the inflatable seals, or only one or two of the inflatable seals may be used. In addition, the inflatable seals may be used in separate tubes from the injectors that are used to blow the swabs through, as was the case with the grit blasting device 14 described above, in which the inflatable seals 40 were separate from the injector nozzles 30 that injected the abrasive material/air mixture.

The control software also may provide visual indications as described in the '706 patent to indicate which tubes have been "swabbed" and which have not and to highlight any tube in which there may have been a problem. For example, if the back pressure did not drop low enough to indicate that the swab had passed through and fully out of the tube, the device 60 itself would have an indicator light or sound an alarm to indicate that there is a problem that needs to be addressed, and the remote unit 62 also would receive a signal from the device 60 indicating a problem at a particular tube that needs follow-up action such as further inspection, removal of other foreign material and so on.

Figure 3:
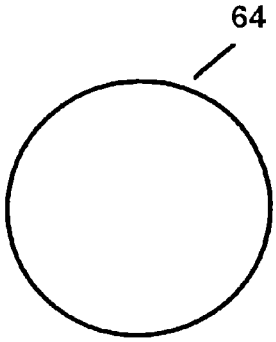
FIG. 3 is a top view of a swab.
Figure 4:
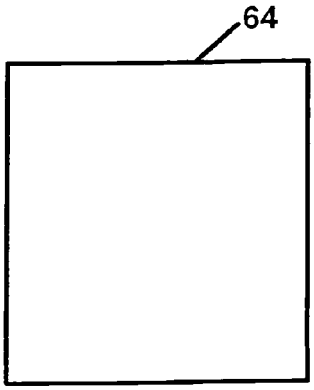
FIG. 4 is a side view of the swab of FIG. 3.

FIGS. 3 and 4 show a typical swab 64, which is a cylindrical piece of polymeric foam or felt or cloth or even a feminine hygiene product such as a Kotex® tampon, which may be combined with abrasive material, and which, when at rest, has an outside diameter larger than the inside diameter of the reactor tube 34 into which it is to be inserted. As is known in the art, the swab 64 is compressed to fit into the reactor tube 34 and flattens out axially under air pressure, applying an outward force against the wall of the reactor tube 34 as it passes through the tube 34, so it swabs or swipes or wipes the wall of the tube 34 as it passes through.

Figure 5:
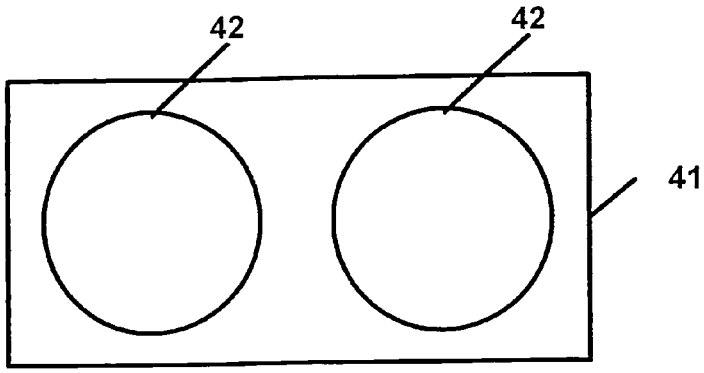
FIG. 5 is a top schematic view of a fixture used for loading swabs into the tubes.
Figure 6:
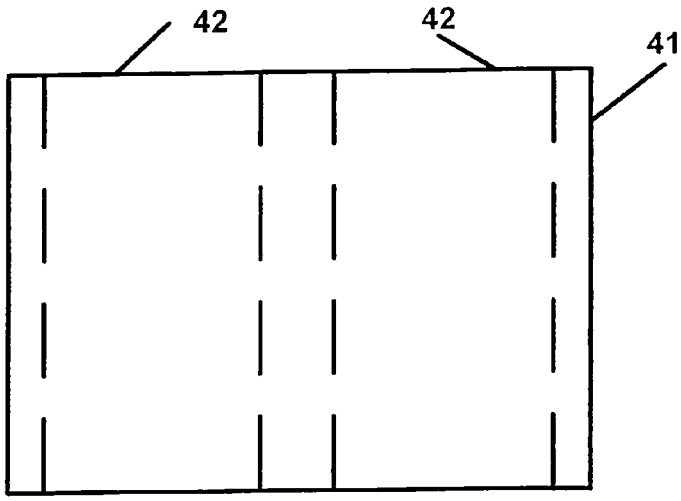
FIG. 6 is a schematic side view of the fixture of FIG. 5.
Figure 7:
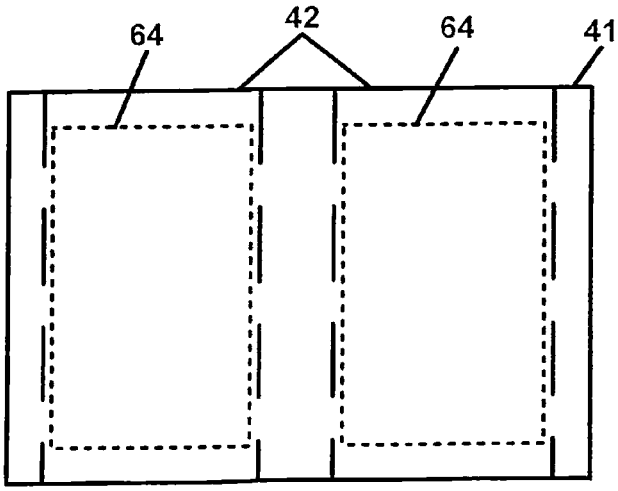
FIG. 7 is the same view as FIG. 6 but with swabs in the fixture.

FIGS. 5-7 show an example of a multiple-hole fixture 41, which defines a plurality of holes 42 that are pre-loaded with swabs 64. The holes 42 in the fixture 41 have a smaller inside diameter than do the reactor tubes 34 into which the swabs 64 are to be inserted.

Figure 8:
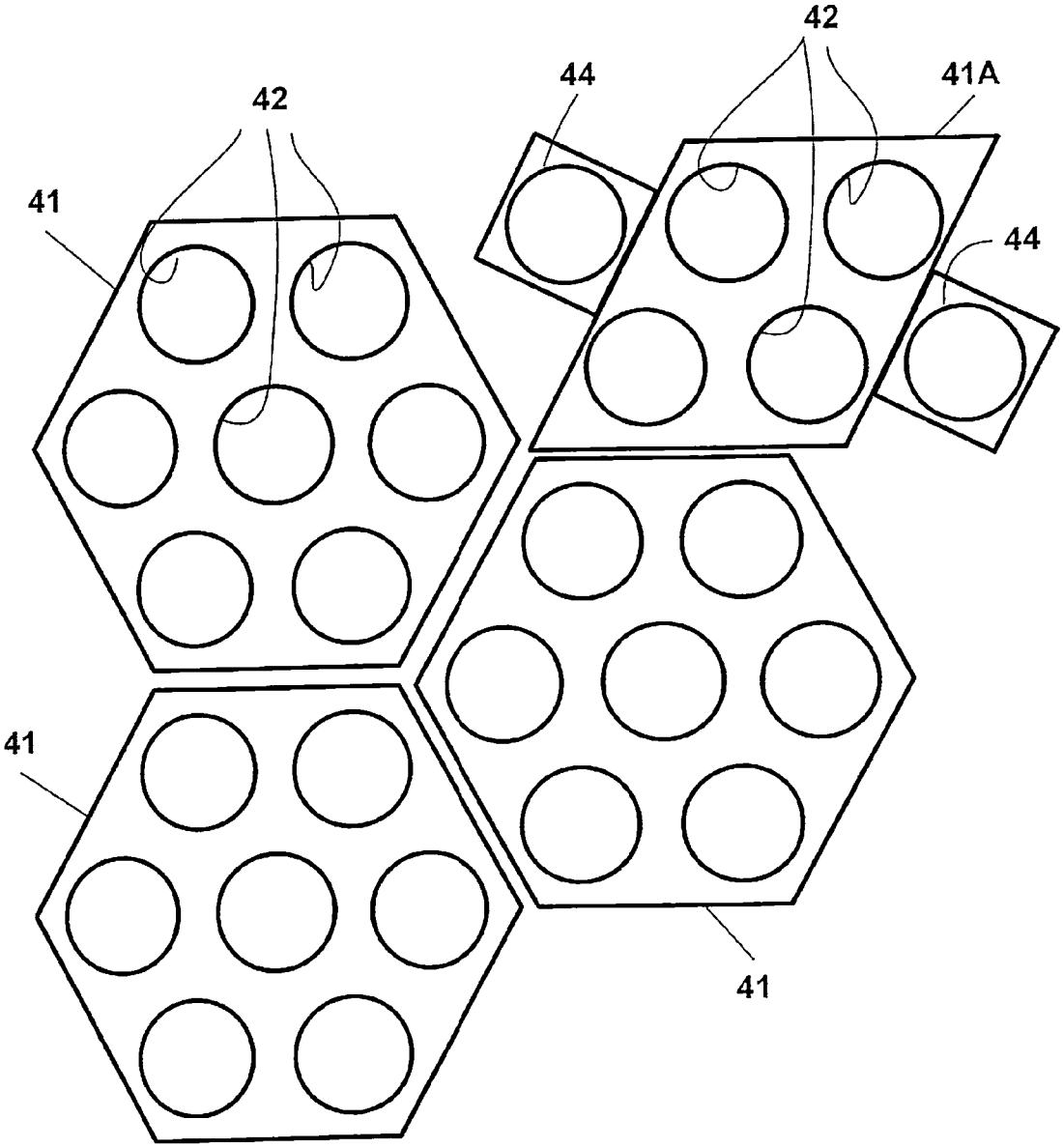
FIG. 8 is a plan view of two types of fixtures for loading swabs.

FIG. 8 shows two different types of multiple-hole fixtures 41, 41A. The fixtures 41 have several holes 42 in them and have an outside shape that enables them to be placed on top of the tube sheet 10 with the holes 42 above and aligned with the reactor tubes 34 like tile pieces to cover a section of the tube sheet 10. In addition to the holes 42, the fixtures 41A have alignment pins 44, which fit into the reactor tubes 34 to ensure that the fixtures are aligned with the reactor tubes 34. Either type of fixtures 41, 41A may be used, or the two types of fixtures 41, 41A may be used together, as shown in FIG. 8 to cover a section of the tube sheet 10. When the fixtures 41 are used, separate pins with flanges (not shown) may be used as needed to ensure that the fixtures 41 are properly aligned with the reactor tubes 34. FIG. 9A shows an alternative type of fixture 41B which has tubular projections 44A extending downwardly from one or more of the holes 42. These projections 44A extend into the tubes 34 to align the fixture 41B with the tubes 34 without interfering with the swabbing. While these fixtures 41, 41A, 41B are shown to cover four or seven reactor tubes 34, they could cover any desired number and could have different shapes. For example, a fixture to be used with the device 60 shown in FIG. 2A may be an elongated strip that covers ten or more reactor tubes 34 in a single row and may include one or more pins 44 projecting into other tubes 34, either in the same row or in an adjacent row or rows.

Figure 9:
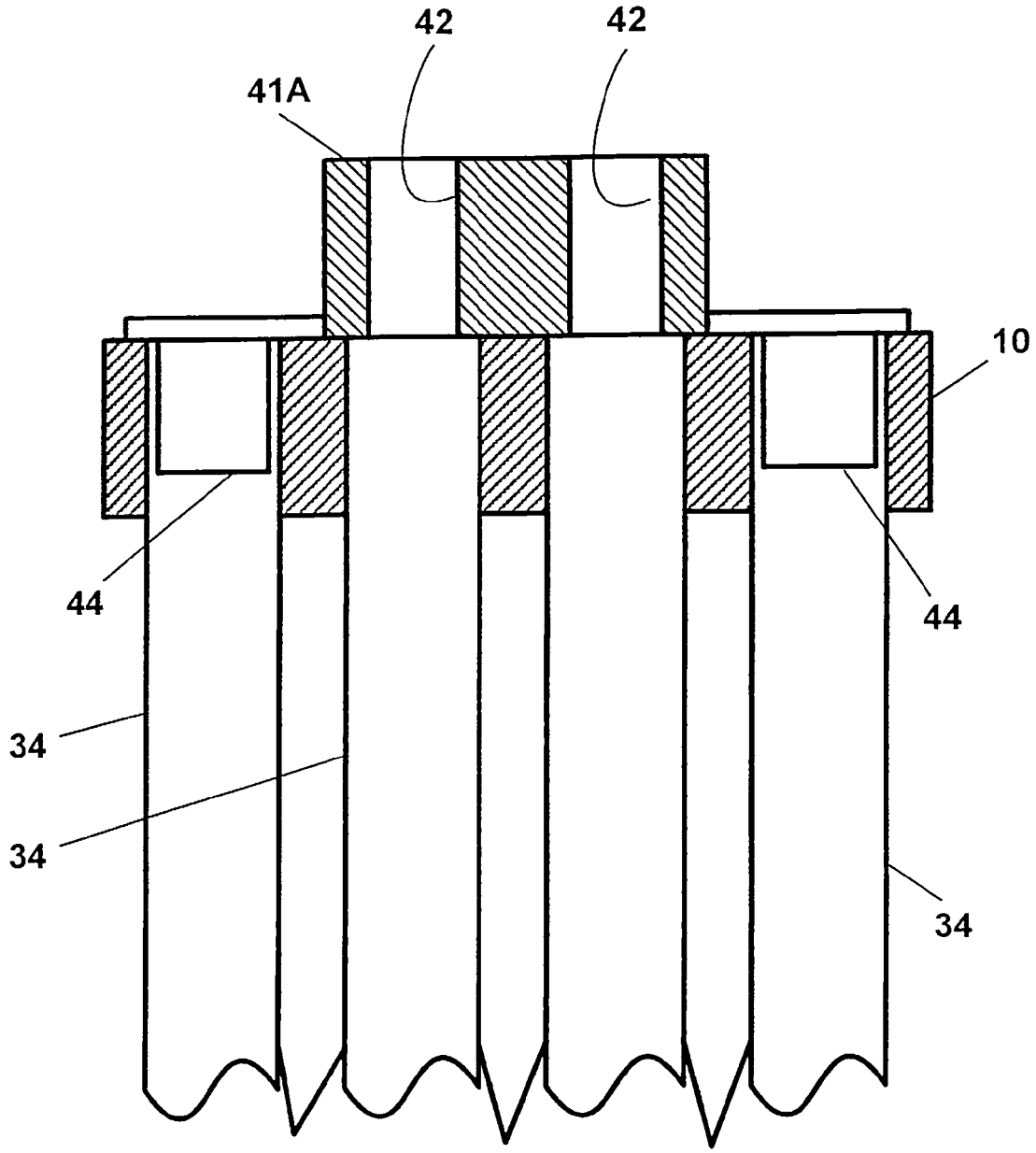
FIG. 9 is a section view showing one of the fixtures of FIG. 8 mounted on the tube sheet.
Figure 9A:
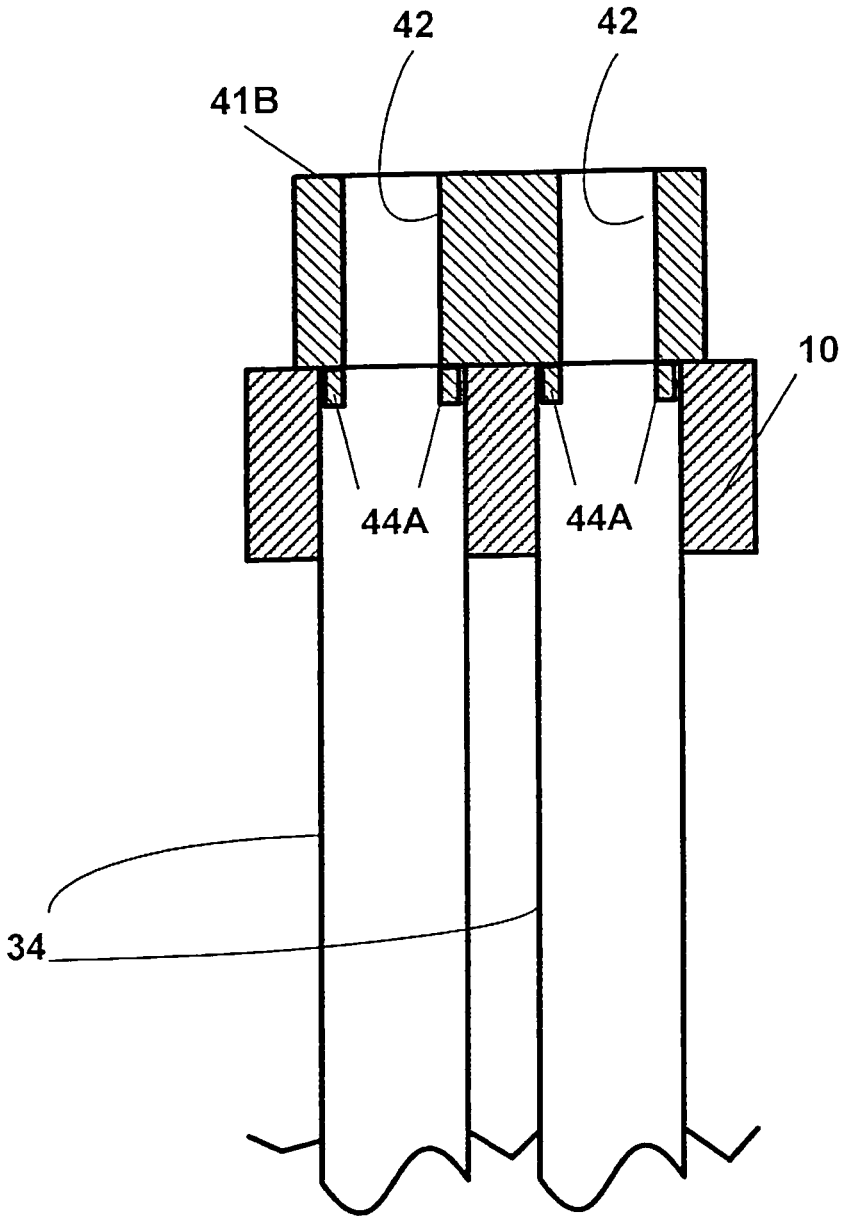
FIG. 9A is a view similar to FIG. 9 but for an alternative fixture.

FIG. 9 shows one of the fixtures 41A installed on the tube sheet 10, with its pins 44 projecting downwardly into the reactor tubes 34 and its holes 42 axially aligned with the reactor tubes 34. It can be seen in this view that the holes 42 in the fixture 41A have a smaller diameter than the diameter of the reactor tubes 34, and the holes 42 are axially aligned with the reactor tubes 34. Although it is not shown in FIG. 9, the holes 42 in the fixture 41A (and the fixtures 41 and 41B) are preloaded with swabs 64, as shown in FIG. 7. Once they are aligned with the reactor tubes 34, a device such as the device 66 shown in FIG. 10 may be used to push the swabs 64 through their respective fixtures 41, 41A, 41B and into their respective reactor tubes 34. The device 66 has a plurality of pins 68, which are clamped onto a rack as described in the '706 patent, so their spacing can be adjusted depending upon the tube spacing of the particular reactor. The handle 69 of the pushing device 66 is at about waist height of the operator to make it convenient to use as the operator is standing up on the tube sheet.

In order to push the swabs 64 through the fixtures and into the reactor tubes, the rigid pushing device 66 is grasped at the handle 69, its pins 68 are aligned with the holes 42, and it is pushed downwardly, pushing the swabs 64 through the fixtures and into the reactor tubes. Once the swabs 64 reach the reactor tubes 34, they expand to fill the reactor tubes 34.

Once the swabs 64 are in their respective reactor tubes 34, the fixtures are removed, the device 60 is inserted into the tops of the reactor tubes 34, the tube seals are inflated, and air is injected through the injector tubes of the device 60 to blow the swabs through their respective tubes, with the device 60 sensing and recording the events of the pressure increase to indicate that the swab is present and the pressure drop to indicate that the swab has passed through the tube, as described above.

Alternatively, the device 60 may be inserted into the fixture(s) in order to blow air into the tubes 34, without having to remove the fixture(s) 41, 41A, 41B.

Alternatively, the device 60 (See FIG. 2A) may be used to blow the swabs 64 through the fixture(s) 41, 41A, 41B and through the reactor tubes in a single step, without having to push the swabs 64 into the tubes 34 first.

Figure 11:
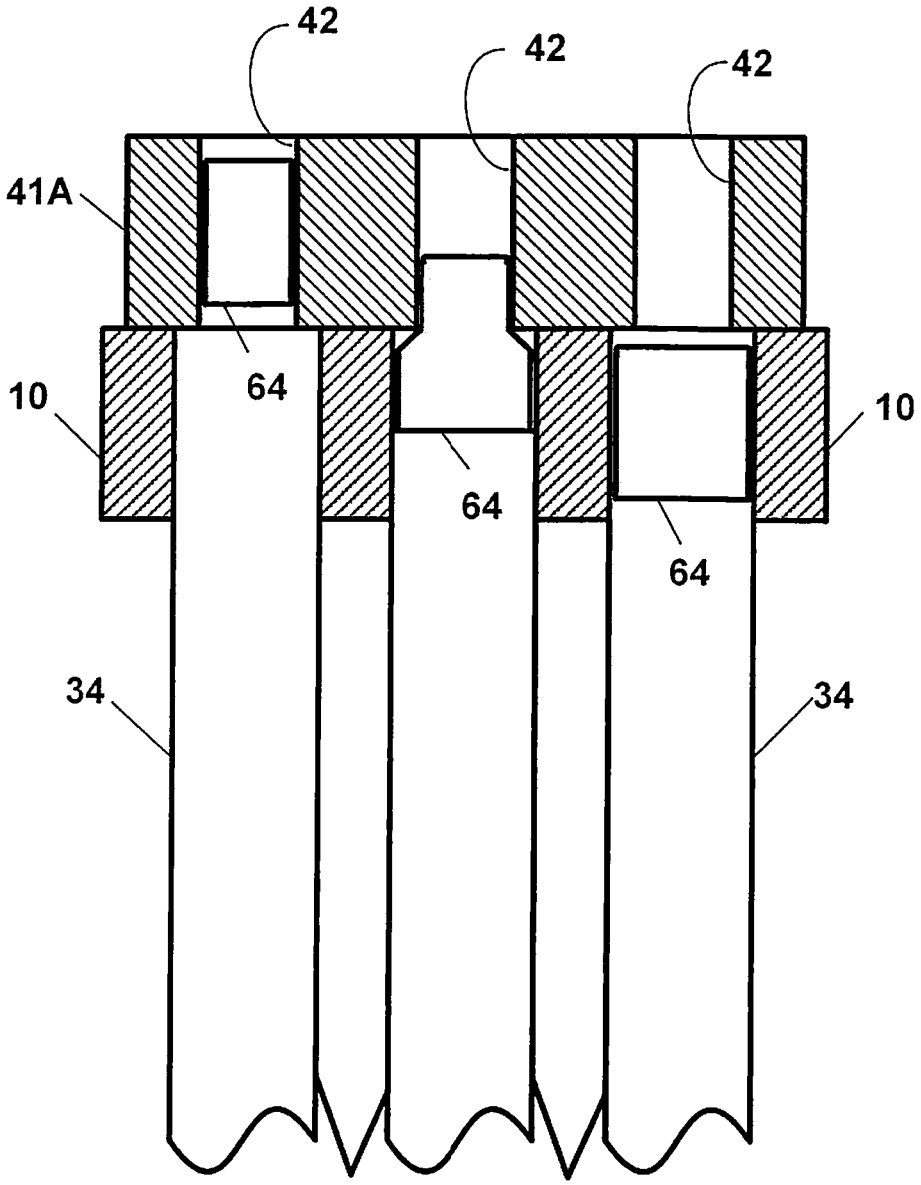
FIG. 11 shows swabs at three different stages as they are pushed from the fixture into the tubes.

FIG. 11 shows swabs 64 at three different positions. The swab 64 on the left is entirely within the fixture 41A. The swab 64 in the center is partially in the fixture 41A and partially in the tube 34, and is expanding as it passes from the fixture 41A into the tube 34. The swab 64 on the right is entirely inside the tube 34 and is expanded radially and compressed axially from its initial position.

Figure 13:
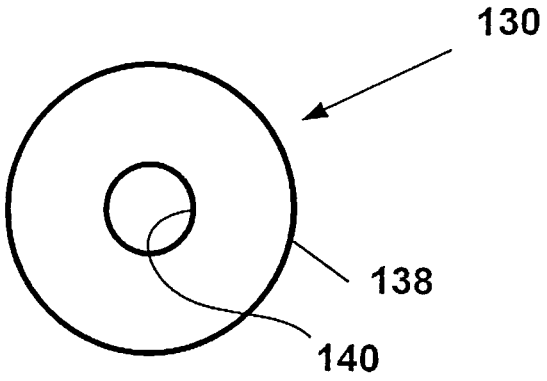
FIG. 13 is a top view of the swab of FIG. 12.
Figure 12:
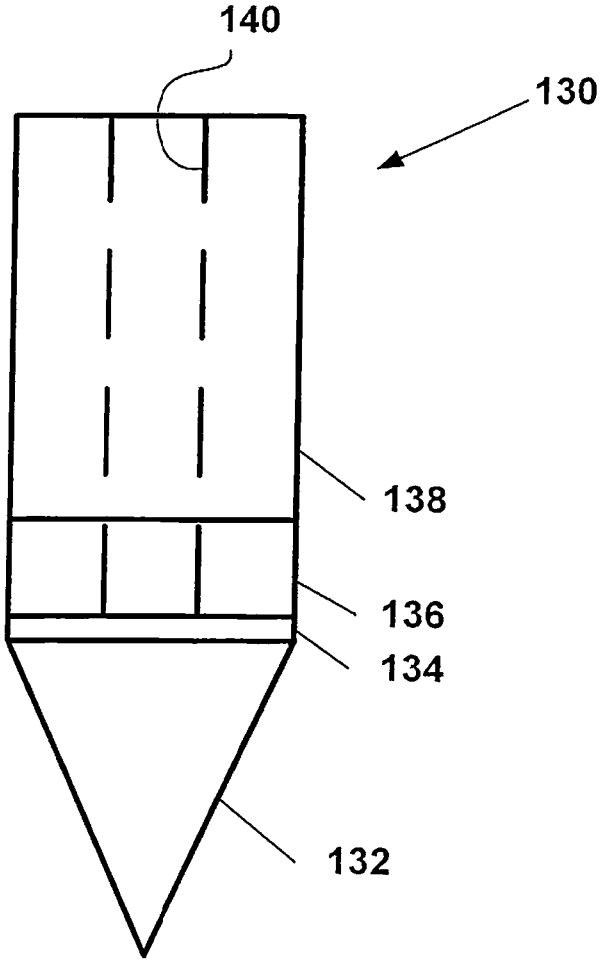
FIG. 12 is a side view of an alternative type of swab.
Figure 14:
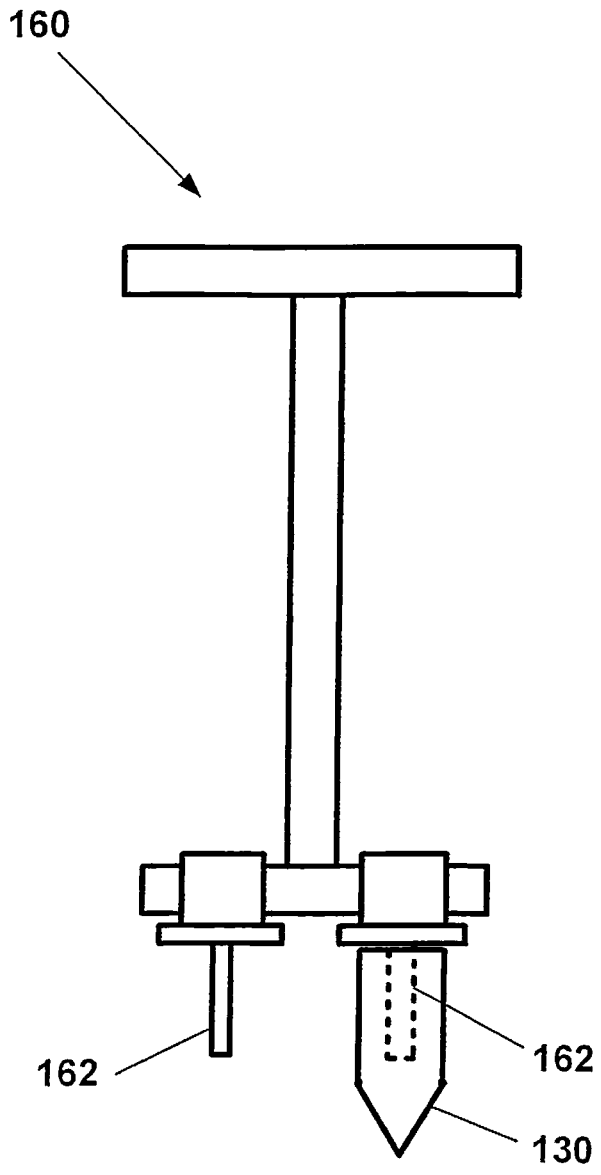
FIG. 14 shows a device that inserts the swabs of FIG. 12 into the tubes.

FIGS. 12 and 13 show a different type of swab 130, which has a conical base 132 a semi-rigid, circular plate 134 on top of the cone 132, a short cylindrical section 136 made of an abrasive material, followed by a softer foam or cloth material 138. The upper portion of the swab 130 above the semi-rigid plate 134 has an axial hole 140. As shown in FIG. 14, this enables the swabs 130 to be premounted onto an installation tool 160, which has downwardly projecting pins 162 spaced apart the same spacing as the reactor tubes 34. The pins 162 of the loading tool 160 are received in the axial holes 140 of the swabs 130 with a snug fit so the swabs 130 do not fall off, and then the tools 160 are aligned with the reactor tubes and are pushed into the tubes to insert the swabs 130 into the tubes. Thereafter, the tool 160 is removed and the device 60 (See FIG. 2A) is used to blow the swabs through the tubes 34.

Alternatively, the installation tool 160 may also provide the air flow paths as described for the device 60, with the pins 162 being hollow and the air flowing through the pins 162. In that case, the installation tool 160 may also measure its position and the back pressure as described earlier, with sufficient precision to ensure that the swabs were present and were blown through and fully out of their respective reactor tubes and to electronically record the events that have occurred with respect to each tube that is treated.

Figure 15:
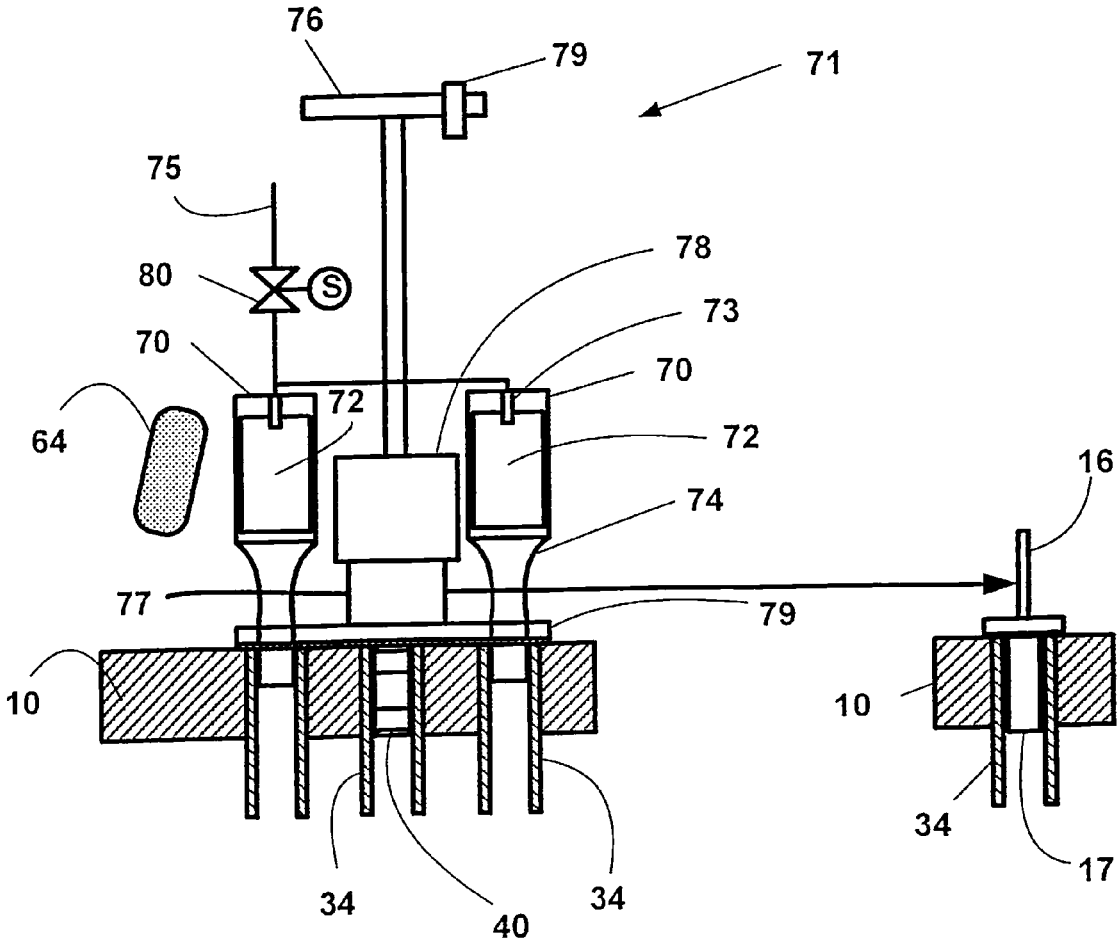
FIG. 15 is a schematic view of an alternative device for loading swabs into tubes.
Figure 16:
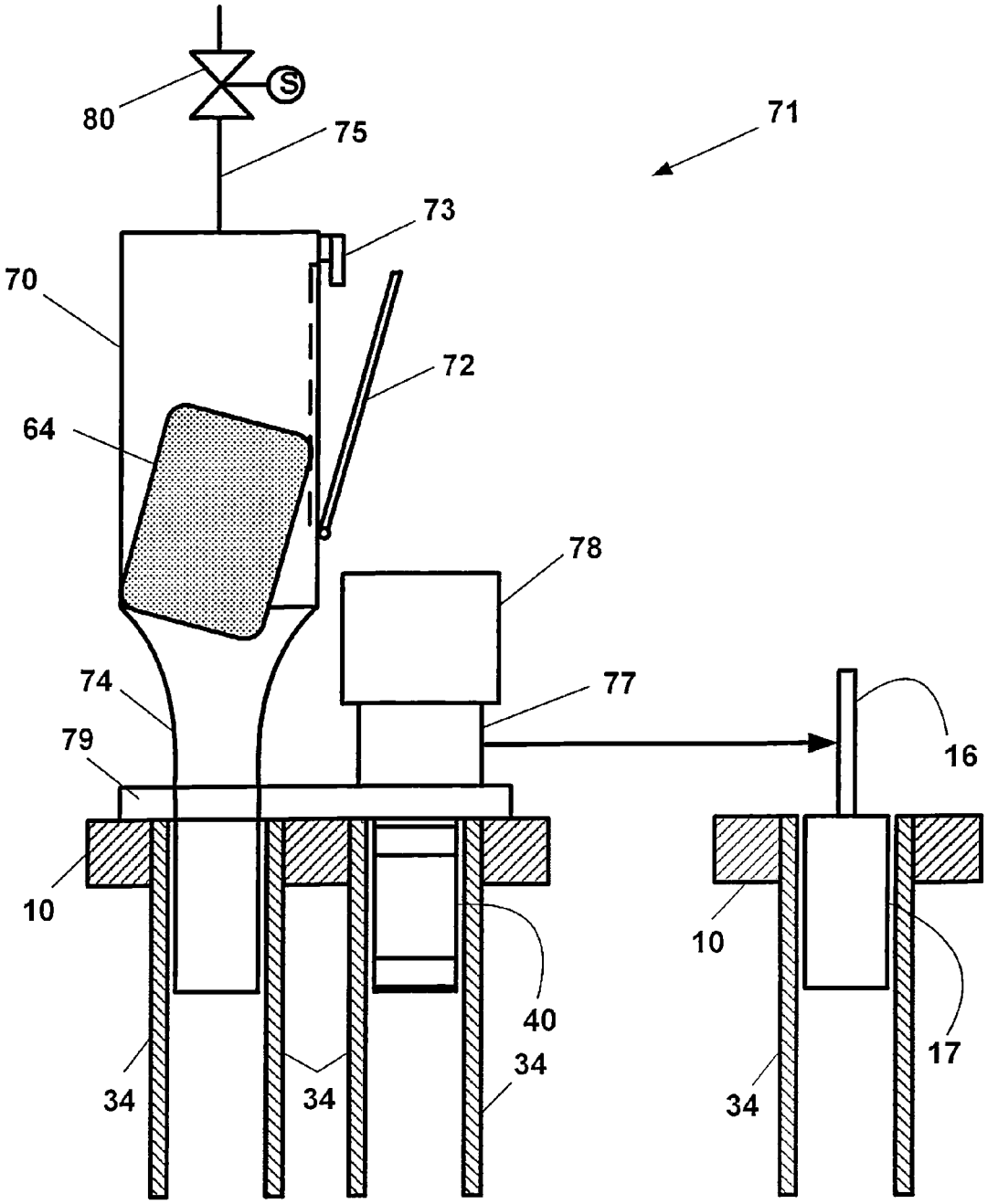
FIG. 16 is an enlarged view of a portion of the device of FIG. 15.

FIGS. 15 and 16 show a schematic of an alternative device 71 that loads and blows multiple swabs through the reactor tubes 34. The device 71 has several passageways 70, each of which has a door 72 for receiving a swab 64 and a throat 74 that fits into a reactor tube 34. The throats 74 are spaced apart with the same spacing as the reactor tubes 34. A gas supply line 75 provides air pressure to the passageways 70. The passageways 70 are rigidly attached to a handle 76, which includes a laser measurement device 77 as described in the '706 patent. A controller 78 is also rigidly attached to the handle 76.

To operate this device 71, the operator aligns the throats 74 with the reactor tubes and lowers them into the tops of their respective reactor tubes. The plate 79 rests on the tube sheet, depressing a spring-biased pin 36 and activating a switch 38 as shown in FIG. 1A, which communicates with the controller 78 to let it know that the device 71 is properly mounted on the tube sheet 10. He also loads a swab 64 into each of the doors 72 and closes the door with the latch 73. Then he presses a start switch 79, and the controller 78 begins an automatic sequence of events, first checking to be sure that the switch 38 has been activated, then inflating one or more tube seals 40 to secure the device 71 to one or more of the reactor tubes 34, then conducting a position measurement using the laser measuring device 77 to determine which reactor tubes are being treated, then opening a gas supply valve 80 to push the swabs 64 through their respective reactor tubes 34. This device 71 may also have one or more pressure sensors, as described earlier, to sense the increase of pressure in each path to a point high enough to indicate the presence of a swab and to push the swab 64 through and then to sense a precipitous drop in the pressure to a low enough level to indicate that the swab 64 has passed through and exited its respective reactor tube 34. In that case, the completion of the operation would automatically be logged electronically for each respective reactor tube with the drop in pressure, indicating that the swab 64 has passed through that tube. This result may appear in a remote display 62 (See FIG. 2A) with color or hatchmarks or some other visual indicator on the representation of the tube sheet, so someone in a control room or other remote location could follow the progress of the operation. It should also be noted that several of these devices 71 may be in use at any time on different parts of the tube sheet 10.

While this embodiment shows the tube seal 40 on a separate part of the device 71 from the injectors 74, there may be an inflatable tube seal on each throat (or injector) 74, as in the device 60, to help ensure that the air that is being injected to push the swab 64 through the tube 34 does not leak upwardly out of the tube 34.

Since it is not unusual for the cleaning procedure for heat exchanger tubes to include grit blasting followed by cleaning with swabs, the following cleaning method could be adopted which includes some of the devices disclosed above:

1—Utilizing one (or more) grit blast modules 14, a group of tubes 34 is grit blasted. As has been described earlier, this includes:

installing a grit blast module 14 over the tube sheet 10 such that at least one tube seal assembly 40 is inserted in a tube 34 ensuring the grit blast module 14 is properly seated on top of the tube sheet 10 by depressing the spring-biased pin 36 against the tube sheet 10 and satisfying the pressure safety interlock switch 38 inflating the tube seal assembly 40 taking a distance measurement to determine which tube is to be grit blasted.

Figure 10:
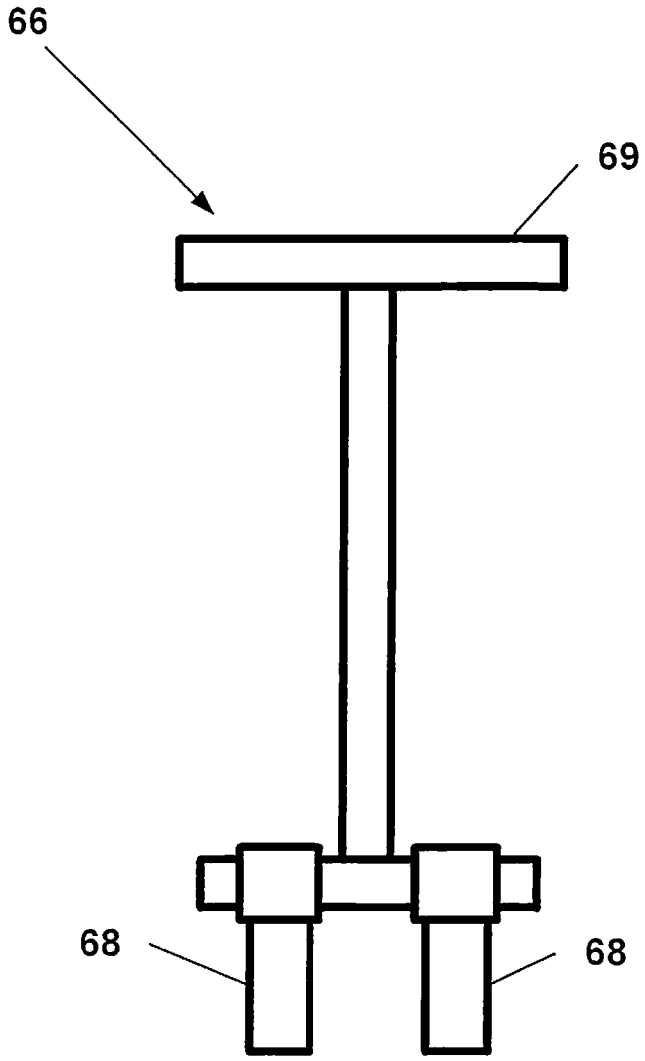
FIG. 10 shows a device that pushes the swabs from the fixture into the tube sheet.

This may involve automatically determining the location of a tube 34 using the laser measurement device 50 which uses the target 16 inserted into a tube 34 via a pin 17 having the controller 52 switch the valve 25 upstream of the pot 24 to allow the compressed air to pick up abrasive material on its way to the nozzle 30 timing the grit blasting procedure to allow the air/abrasive material mixture to enter each tube for a standardized period of time. Timers may indicate both time remaining before the blasting procedure is complete as well as time elapsed since the cycle was completed automatically recording the event and the location of the tubes which have been grit blasted interrupting the air flow to the nozzles 30 deflating the tube seal assembly 40 and moving the grit blast module 14 to a new location Then, 2—loading swabs 64 into the tubes which have been grit blasted in step 1 above. This may include:

using a loading fixture and a swab loading device such as the device 66 of FIG. 10, or forego the use of a loading fixture and use instead the device 160 of FIG. 14, or the device 71 of FIGS. 15 and 16

Finally,

3—forcing the installed swabs 64 through their respective tubes using pressurized gas and sensing the pressure rise and drop to indicate the presence of the swab in a tube and the fact that the swab has been blown through the tube, and automatically electronically recording those events for that respective tube.

If either the pressure spike or the pressure drop does not occur, the device that is being used to blow the swabs through the tubes would raise an alarm. The alarm may be an audible alarm, a flashing light, an error message in the display, and/or a visual indication of the alarm condition at the remote computer 62.

While the tubes described here are chemical reactor tubes, the equipment and method described above could be used for cleaning out the tubes of other heat exchangers or other types of tubes as well. It will be obvious to those skilled in the art that various modifications may be made to the embodiments described above without departing from the scope of the present invention as claimed.

What is claimed is:

1. A method of cleaning tubes, comprising the steps of:

inserting a plurality of swabs into a fixture having a plurality of holes and aligning the holes of the fixture with a respective plurality of tubes; then applying pressurized gas behind one of the swabs to blow the swab through the respective tube; and sensing the back pressure in the tube while blowing the swab through the tube, noting from a decrease in pressure that the swab has passed completely through the tube.

2. A method of cleaning tubes as recited in claim 1, and further comprising the step of automatically identifying the tube being cleaned and automatically electronically recording the completion of the swabbing of the identified tube.

3. A method of cleaning tubes as recited in claim 2, wherein the step of automatically identifying the tube being cleaned includes the step of measuring the position of the tube.

4. A method of cleaning tubes as recited in claim 3, wherein the step of measuring the position of the tube includes using a laser distance measurement device.

5. A method of cleaning tubes as recited in claim 1, and further comprising the step of pushing the swabs through the fixture and into their respective tubes prior to applying pressurized gas to blow the swabs through their respective tubes.

6. A method of cleaning tubes as recited in claim 1, and further comprising the steps of inserting an injector into the tube and sealing between the injector and the tube prior to applying pressurized gas through the injector behind the swab.

7. A method of cleaning tubes as recited in claim 1, and further comprising the step of blowing abrasive material through the tube prior to blowing the swab through the tube.

8. A method of cleaning tubes as recited in claim 7, and further comprising the step of using an inflatable seal to secure a device relative to the tube before blowing abrasive material through the device and through the tube.

9. A method of cleaning tubes as recited in claim 1, wherein the respective tubes are the tubes of a shell and tube heat exchanger.

10. A method of cleaning tubes as recited in claim 9, and further comprising the step of automatically identifying the tube being cleaned and automatically electronically recording the completion of the swabbing of the identified tube.

11. A method of cleaning tubes as recited in claim 10, wherein the step of automatically identifying the tube being cleaned includes the step of measuring the position of the tube.

12. A method of cleaning tubes as recited in claim 11, wherein the step of measuring the position of the tube includes using a laser distance measurement device.

13. A method of cleaning tubes as recited in claim 9, and further comprising the step of pushing the swabs through the fixture and into their respective tubes prior to applying pressurized gas to blow the swabs through their respective tubes.

14. A method of cleaning tubes as recited in claim 9, and further comprising the steps of inserting an injector into the tube and sealing between the injector and the tube prior to applying pressurized gas through the injector behind the swab.

15. A method of cleaning tubes as recited in claim 9, and further comprising the step of blowing abrasive material through the tube prior to blowing the swab through the tube.

16. A method of cleaning tubes as recited in claim 15, and further comprising the step of using an inflatable seal to secure a device relative to the tube before blowing abrasive material through the device and through the tube.

* * * * *